United States Patent [19]

Chernewski

[11] 4,071,976

[45] Feb. 7, 1978

[54] HOLDING DEVICE

[75] Inventor: Albert J. Chernewski, Brooklyn, N.Y.

[73] Assignee: House of Hints Corporation, Brooklyn, N.Y.

[21] Appl. No.: 787,871

[22] Filed: Apr. 15, 1977

Related U.S. Application Data

[63] Continuation of Ser. No. 556,228, March 7, 1975, abandoned.

[51] Int. Cl.[2] ..... A47G 7/00

[52] U.S. Cl. ..... 47/39; 47/67; 248/311.1; 248/313

[58] Field of Search ..... 47/39, 40, 40.5, 41, 47/41.1, 41.11, 41.12, 41.13, 67, 68; 248/311.1, 310, 311.2, 312, 313

[56] References Cited

U.S. PATENT DOCUMENTS

| | | | |
|---|---|---|---|
| D. 191,874 | 12/1961 | Yegge | 47/67 X |
| 753,485 | 3/1904 | Gridley | 47/39 X |
| 1,446,036 | 2/1923 | Dodd | 248/311.1 |
| 1,930,673 | 10/1933 | Consolazio | 47/40 X |
| 2,266,294 | 12/1941 | Allderdice | 248/311.1 |
| 2,671,624 | 3/1954 | Carney | 47/40.5 |
| 2,732,954 | 1/1956 | Janonis et al. | 47/66 X |
| 2,883,139 | 4/1959 | Dobkin | 248/311.1 |
| 2,936,149 | 5/1960 | Reeg | 248/313 |
| 2,967,691 | 1/1961 | Lehnbeuter et al. | 47/39 X |
| 3,273,841 | 9/1966 | Cota | 47/39 X |

FOREIGN PATENT DOCUMENTS

| | | | |
|---|---|---|---|
| 1,424,244 | 11/1965 | France | 47/67 |
| 377,362 | 7/1932 | United Kingdom | 47/39 |
| 1,169,919 | 11/1969 | United Kingdom | 248/313 |

*Primary Examiner*—Edgar S. Burr
*Assistant Examiner*—James R. Feyrer
*Attorney, Agent, or Firm*—Jacobs & Jacobs

[57] ABSTRACT

A holding device which is particularly suitable for holding potted plants, flower boxes and the like on saucers and the like on a wall is constructed which comprises an L-shaped unit comprising a vertical mounting member which is secured to the wall having ribs along the surface and the side portions of which terminate in lips which form a slot, means for securing said vertical mounting member to a wall, a horizontal support member integral with said vertical mounting member at a substantially right angle thereto and having an angularly disposed protuberance running from the lower portion of said vertical mounting member to the rear portion of said horizontal support member, said horizontal support member also having ribs along its surface and a holding member comprising a body portion which terminates at its upper portion in a downturned tongue, said body portion having ribs along its surface and at the end opposite the downturned tongue a slot which mates with the protuberance. Said holding member is sized such as to fit within the slot formed in the vertical mounting member by the lips.

3 Claims, 4 Drawing Figures

HOLDING DEVICE

CROSS-REFERENCE

This is a continuation, of Ser. No. 556,228 filed Mar. 7, 1975 now abandoned.

The present invention is concerned with units for holding items on a wall and is particularly suitable for holding potted plants, flower pots, flower boxes, cubes and the like in a mounted position on a wall.

More particularly, the present invention comprises an L-shaped unit comprising a vertical mounting member having ribs along its surface, the side portions of which terminate in lips which form a slot, means for securing said vertical mounting member to a wall, and a horizontal support member integral with said vertical mounting member and at a substantial right angle thereto, said horizontal support member being joined to said vertical mounting member through a protuberance and said horizontal support member having ribs along its surface. The potted plant or other object to be held in position is secured to the L-shaped unit by virtue of a holding member which comprises a body portion having ribs along its surface and one end of which terminates in a downturned tongue which will fit over the edge of the potted plant or other object to be held in position, while the opposite end of said body portion has a slot which mates with the protuberance. The holding member is sized such as to fit within the slot formed on the vertical mounting member by the lips described above.

Turning now to the drawings which more particularly illustrate the present invention, FIG. 1 shows a frontal view of the L-shaped unit and holding member of the present invention;

Figure 1:
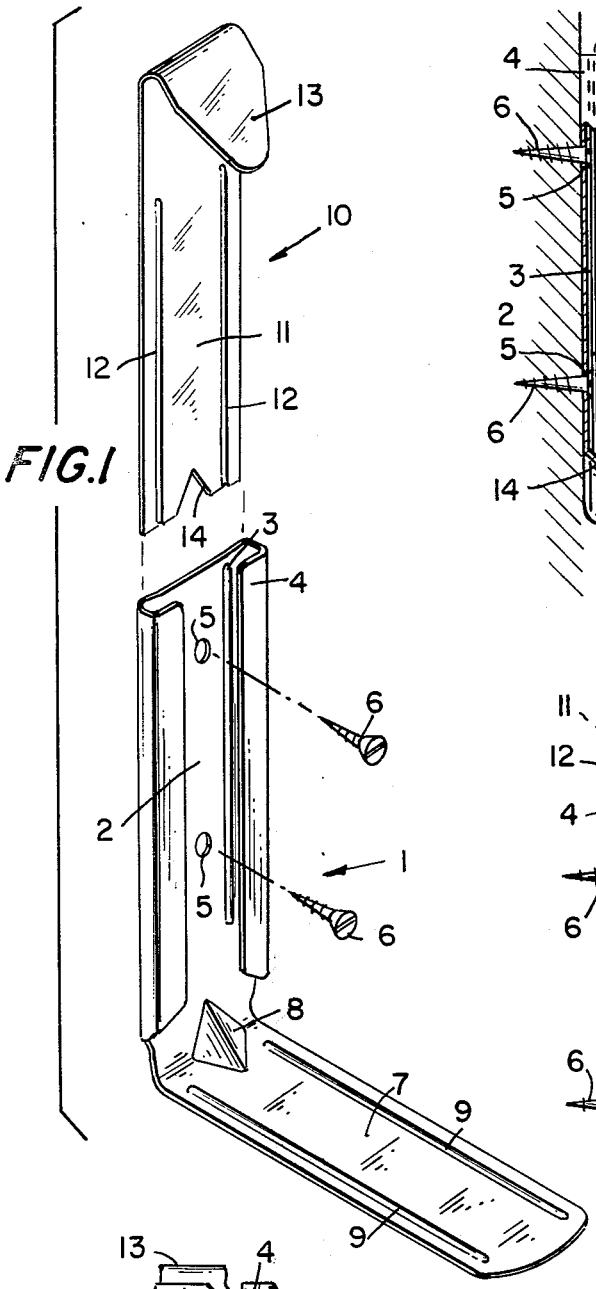

Referring to the drawings, L-shaped unit 1 comprises vertical mounting member 2 which has ribs 3 along its surface and the sides of which terminate in lips 4 to form a slot.

Figure 2:
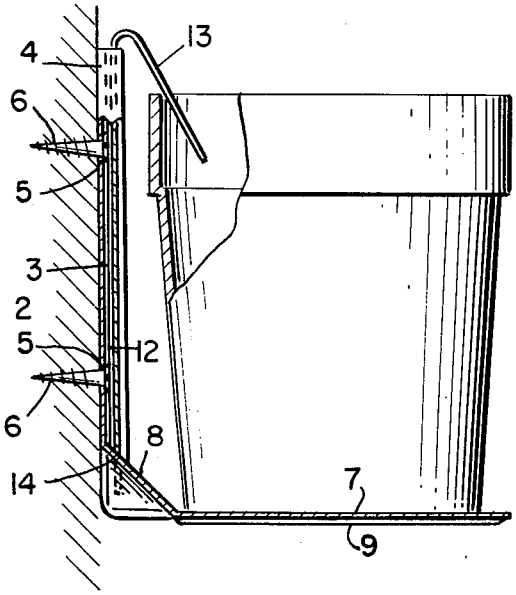
FIG. 2 shows a side view of the present invention with a potted plant secured in position on a wall.

Vertical mounting member 2 has means for securing it to a wall, such as screw holes 5 into which screws 6 may be fitted and screwed into a wall as shown in FIGS. 1 and 2.

Horizontal support member 7 is integral with vertical mounting member 2 at a substantial right angle thereto and protuberance 8, which is angularly disposed, runs from the lower portion of vertical mounting member 2 to the rearward portion of horizontal support member 7. Horizontal support member 7 also has ribs 9 which are similar to ribs 3. These ribs provide added rigidity and strength to the L-shaped unit 1.

Holding member 10, which comprises body portion 11 which has ribs 12 along its surface similar to ribs 3 and 9, has one end which terminates in a downturned tongue 13 and the other end of which contains a slot 14 which mates with protuberance 8. Holding member 10 is sized such as to fit within a slot formed in the vertical mounting member 2 by the lips 4, as shown in FIGS. 1 through 4.

Figure 3:
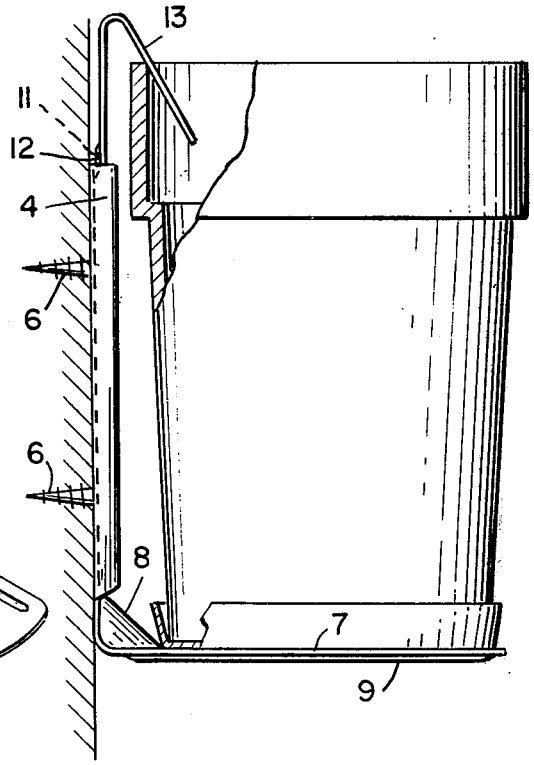
FIG. 3 is similar to FIG. 2 but shows a larger potted plant held in position on a saucer.
Figure 4:
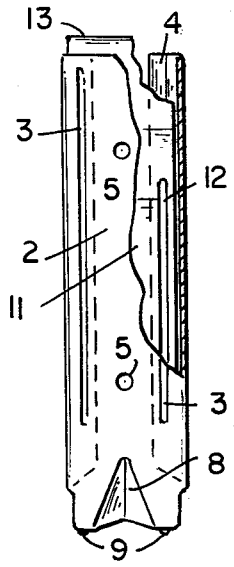
FIG. 4 is a rear view of the present invention.

In operation, the L-shaped unit is secured to a wall, such as by inserting screws 6 through screw holes 5, as shown in FIGS. 1 and 2, and a potted plant or similar object is placed on the L-shaped unit as shown in FIGS. 2 and 3. The holding member 10 is then fitted into the slot formed by lips 4 and pushed down until the downturned tongue 13 rests securely over the edge of the potted plant or other member to be held in position, as shown in FIGS. 2 and 3.

When a flower pot or potted plant is held in place, it may rest on a saucer (FIG. 3) or other object suitable to prevent dissipation of the water which will, from time to time, be poured onto the flower pot or potted plant.

As an alternative to securing the L-shaped unit to a wall or other structure, attachment can be done by applying an adhesive backing to the vertical mounting member.

The L-shaped unit can be constructed of metal, an alloy, plastic or other suitable material.

Other and further uses of the present invention will be more fully appreciated by those skilled in the art.

I claim:

1. A device for mounting and holding a flower pot or the like in spaced relationship to a wall or other vertical surface, said device comprising an L-shaped unit having a vertically extending portion adapted to be secured to the wall or vertical surface through spaced holes arranged centrally thereof and through which screws or the like can pass, the vertically extending portion having its edges inturned to form U-shaped channels of a width leaving said holes exposed, ribs extending along the vertically extending portion underlying the inturned edges and substantially coextensive in length therewith and a horizontally extending portion integral with the said vertically extending portion and provided with ribs on which the flower pot or the like rests, the juncture formed between the vertically and horizontally extending portions having an angularly disposed protuberance strengthening the juncture against downward movement of the horizontally extending portion under the weight of the flower pot or the like and said ribs providing airspace below the bottom of the flower pot or the like, said device also comprising a separate holding member slidable in said channels, having ribs matching with the ribs in the vertically extending portion and an angularly downturned upper end adapted to extend over the top of the flower pot or the like in stabilizing contact therewith, the lowermost edge of the slidable member having a central inverted V-shaped notch for reception of the angularly disposed protuberance and for limiting downward movement of the slidable member.

2. A device according to claim 1 wherein the vertically and horizontally extending portions of the L-shaped unit and the slidable holding member are of generally rectangular shape.

3. A device according to claim 1 wherein a saucer is disposed between the ribs of the horizontally extending portion and the flower pot or the like.

* * * * *